US006447855B1

(12) United States Patent
Haas et al.

(10) Patent No.: US 6,447,855 B1
(45) Date of Patent: Sep. 10, 2002

(54) DEVICE AND METHOD FOR DUSTING SMOOTH OR SHEET-LIKE PRODUCTS

(75) Inventors: Reiner Haas, Metzingen; Günther Hess, Reutlingen, both of (DE)

(73) Assignee: Weitmann & Konrad GmbH & Co. KG, Leinfelden-Echterdingen (DE)

( * ) Notice: Subject to any disclaimer, the term of this patent is extended or adjusted under 35 U.S.C. 154(b) by 0 days.

(21) Appl. No.: 09/731,825

(22) Filed: Dec. 8, 2000

Related U.S. Application Data

(63) Continuation of application No. 09/147,768, filed as application No. PCT/EP97/04394 on Aug. 13, 1997, now abandoned.

(30) Foreign Application Priority Data

Sep. 4, 1996 (DE) ..... 196 35 830

(51) Int. Cl.[7] ..... B05D 1/06; B05D 1/12; B05C 5/00; B05B 7/00

(52) U.S. Cl. ..... 427/598; 427/180; 427/421; 427/547; 118/621; 118/623; 156/272.2; 156/390; 430/106.1; 430/902

(58) Field of Search ..... 118/621, 622, 118/623, 641, 58; 156/230, 240, 247, 277, 289, 272.2, 272.4, 273.3, 540, 542, 379.6, 390; 427/180, 190, 427, 457, 547, 598, 421, 191; 347/22, 34, 53; 15/1.51; 430/106.1, 120, 126, 902

(56) References Cited

U.S. PATENT DOCUMENTS

| | | | | | |
|---|---|---|---|---|---|
| 2,027,087 | A | * | 1/1936 | Buckner | 91/68 |
| 4,156,036 | A | * | 5/1979 | Lennon et al. | 427/47 |
| 4,475,979 | A | * | 10/1984 | Idstein et al. | 156/542 |
| 4,598,870 | A | * | 7/1986 | Schloz | 239/696 |

FOREIGN PATENT DOCUMENTS

| | | | | | |
|---|---|---|---|---|---|
| JP | 58-31773 | A | * | 2/1983 | B41J/3/16 |
| JP | 64-24796 | A | * | 1/1989 | B41M/7/02 |

* cited by examiner

*Primary Examiner*—Jerry A. Lorengo
(74) *Attorney, Agent, or Firm*—Paul Vincent

(57) ABSTRACT

The present invention relates to a device and method for dusting smooth or sheet-like products, comprising at least one duster for spraying an air/powder mixture on said products. In order to ensure efficient dusting with no dirt accumulation in the printer or the surrounding area, it is suggested that part of the powder particles be magnetized and means be provided for creating a magnetic field in the powder deposit area so that said powder particles are subjected to a force drawing them towards the product.

11 Claims, 3 Drawing Sheets

DEVICE AND METHOD FOR DUSTING SMOOTH OR SHEET-LIKE PRODUCTS

This application is a continuation of application Ser. No. 09/147,768 filed Mar. 4, 1999 now abandoned, which is a 371 of PCT/EP97/043 94 filed on Aug. 13, 1997 the complete disclosure of which is hereby incorporated by reference.

BACKGROUND OF THE INVENTION

The present invention relates to a device for dusting stripor sheet-shaped products with which a powder/air mixture is sprayed on the products and to a method for dusting such products.

Such devices and method for dusting are, for example, employed in stacking devices for printed sheets of paper in a sheet-fed offset printing press, so that for drying the printing ink the individual sheets of paper are separated from each other by means of, a powder. In the course of this the problem occurs, that the very fine-grained powder, which is applied to the sheets of paper via an air stream, is only partially deposited on the sheet of paper. Strong air eddy currents occur because of the high conveying speeds of the sheets of paper—apporoximately 15,000 sheets per hour—, so that a large fraction of the powder does not reach and remain on the sheet of paper, but adds to the contamination of the printing press, and of the ambient air. For improving the effectiveness of the dusting it was proposed in accordance with DE-OS 26 46 798 to charge the powder particles and to apply them in the charged state to the sheet of paper. A further device is known from DE-OS 29 46 754, with which the powder to be deposited on the sheet of paper is, in essentially electrically neutral form, dispensed from nozzles and is charged by means of a corona discharge prior to impact on the sheet of paper. This method has the disadvantage that, although the charged powder better adheres to the sheets of paper, it also adheres better to all parts of the press, in particular those that are metallically neutral. The parts of the press are thereby covered with a thick layer of powder in a short time.

For this reason a further device was proposed by DE-OS 33 30 665, in which the powder is electrically neutralized when leaving the nozzle. Although the electrostatic adhesion of powder to metallic parts of the press is prevented, the original problems once more occur, with the very fine-grained powder contaminating large areas of the printing press and the surroundings due to air currents.

The known devices therefore offer only insufficient solutions to the dusting problem, because, in the final analysis, only a small amount of the powder is deposited and remains on the sheet of paper and contamination of the printing press, and of the surroundings, is inadequately prevented. Based on this prior art, it is the object of the invention to provide an improved device and method for dusting moving objects, by means of which the powder can be effectively deposited on the sheets of paper, wherein a contamination of the printing press and the surroundings is reduced.

This object is achieved by a device including means for generating a magnetic field in the deposition area so that a force is exerted on the magnetized powder particle in a direction toward the product, and by a method according to which the powder particles are magnetized prior to impacting the product and are deposited on the product by means of a magnetic force acting on the magnetized powder particles.

A powder/air mixture can be sprayed in a known manner on the sheet of paper by means of the device of the invention, wherein in accordance with the invention the individual powder particles of the powder can be magnetized. Means are furthermore provided for creating a magnetic field in the deposition area of the powder, so that a force in the direction toward the sheet of paper acts on the magnetized powder particles. In this manner, the powder can be better separated from the air carrying it. The magnetic forces are greater than the electrostatic forces of known dusting devices. The known electrostatic forces assist in holding only the powder which has already been deposited on the sheet of paper. But by means of the device of the invention and the corresponding method, the not yet deposited powder can already be effectively influenced by the magnetic forces and can be better separated from the air carrying it.

The flow speed of the powder/air mixture can be increased, as a result of which the powder-carrying air flow is less sensitive to disturbances and therefore the surrounding press elements are less contaminated.

Since the magnetic force leads to better separation of the powder particles from the air carrying them as well as to a more effective deposition of the powder on the sheet of paper, the amount of powder used can be reduced.

Advantageous embodiments of the device in accordance with the invention are the subject the dependent claims.

Permanent or electromagnets can be used for generating the magnetic field. Electromagnets are preferred, since they can be switched off, for example, for cleaning the printing press, and can therefore be better cleaned of adhering powder.

In an advantageous manner the magnet is arranged in such a way that the product can be passed through between one pole and the spray nozzle, so that the sheet of paper to be dusted can be conveyed directly over one pole of the magnet, so that the strongest possible magnetic field prevails in the deposition area of the powder.

In an embodiment of the invention in which the magnet has a U-profile whose legs form poles which extend transverse to the transport direction and across the width of the product, it is assured that an even magnetic force acts on the powder over the entire width of the sheet of paper.

An embodiment of the invention comprises means including a plurality of electromagnets arranged parallel and transversely to the transport direction. This permits adaptation of the magnetic field to various paper widths by activating only the magnets covered by the sheet of paper to be dusted.

In accordance with another embodiment one pole of the magnet(s) is preferably arranged in the deposition area of the powder, since the greatest strength of the magnetic field prevails in the pole area. The other pole is preferably arranged downstream in the conveying direction, so that the non-deposited powder once more experiences a force in the direction toward the sheet of paper at that location. The efficiency of deposition is thereby increased.

The sheets of paper are transported past the spraying nozzle by conveying means. So that the conveying means do not interfere with the magnetic field, they preferably primarily consist of a non-magnetizable material, for example plastic. A gripper element, by means of which the sheet is grasped at its front end for conveying, is however made of a magnetizable material. In this manner, strong magnetic fields are generated at the front edge of the sheet, so that the deposition of powder is assisted by the magnetic force in this area, which would otherwise only be insufficiently dusted with powder by means of known devices.

The magnetizable powder can consist of covered or coated iron particles, or of powder particles having covering iron particles on their surface. Iron is ferromagnetic and therefore strongly magnetizable. The iron particles should be covered or coated, so that the iron cannot oxidize and leave unwanted spots on the sheet of paper.

The invention will be explained in detail in what follows by means of an exemplary embodiment, making reference to the drawings.

DESCRIPTION OF THE PREFERRED EMBODIMENT

Figure 2:
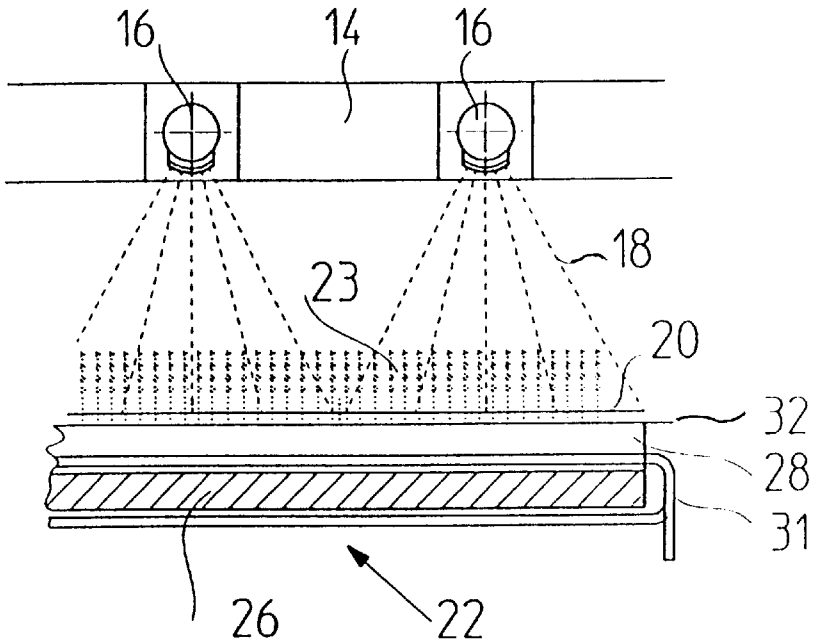
FIG. 2 shows a plan view along the line II—II of FIG. 1.

A device 10 in accordance with the invention, represented in the drawings, has a spray bar 14 arranged transversely to a conveying direction 12, which has spray nozzles 16, by means of which a powder/air mixture, represented by dashed lines 18, can be sprayed over the width of the product to be sprayed, a sheet of paper 20 in the exemplary embodiment shown. For spraying, the sheet of paper 20 is pulled past the spray nozzles 16 in the conveying direction 12 by means of suitable conveying means 38.

The powder consists of individual magnetizable powder particles, which preferably consist of covered or coated iron particles. In an alternative embodiment the powder particles consist of known materials, for example starch or calcium carbonate, and have covering iron particles on their surface.

The device 10 furthermore comprises means 22, with which a magnetic field represented by dotted lines 23 can be generated in the deposition area 24 of the powder, i.e. on the surface of the sheet of paper 20. The powder particles entering the magnetic field are magnetized by the magnetic field 23. The magnetic field is generated in such a way that a magnetic force acts on the powder particles in the direction toward the sheet of paper 20.

The means 22 can include at least one permanent magnet. In a first embodiment of the invention, the means include an electromagnet 26 (FIG. 1), which is arranged in such a way that the sheet of paper can be passed through between at least one pole 28 and the spray nozzles 16.

Figure 1:
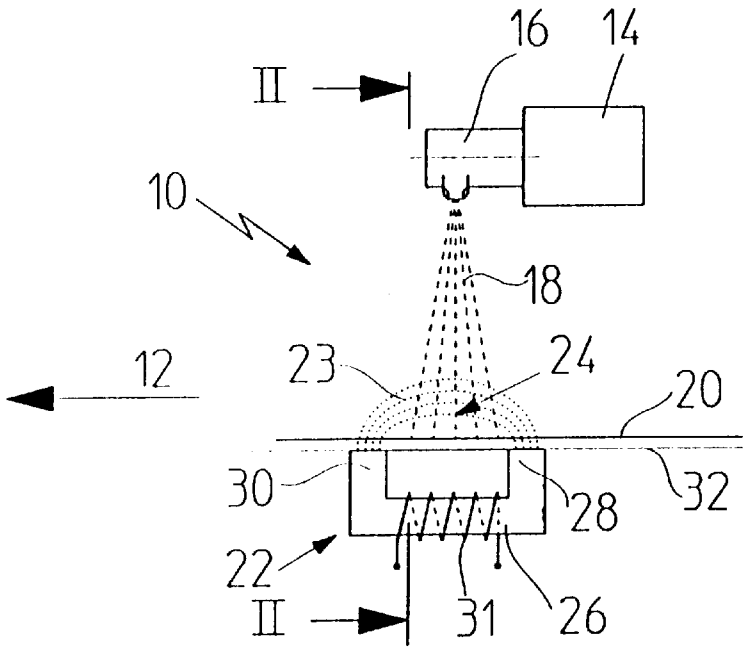
FIG. 1 shows a greatly schematized side view of a device in accordance with the invention.

Preferably both poles 28 and 30 of the electromagnet 26 are arranged underneath a sheet guidance panel 32 guiding the sheet of paper 20 (FIG. 1). The sheet of paper 20 is securely guided by this and the contamination of the electromagnet 26 is prevented.

In the exemplary embodiment represented in FIGS. 1 and 2, the electromagnet 26 is formed by a U-profile, whose U-legs form the poles 28 and 30, and which extends transversely to the conveying direction 12, across the width of the product. Therefore the poles 28 and 30 extend over the entire width of the sheet of paper 20. A coil 31, through which current flows, generates the magnetic field in the iron core of the magnet 26.

Figure 4:
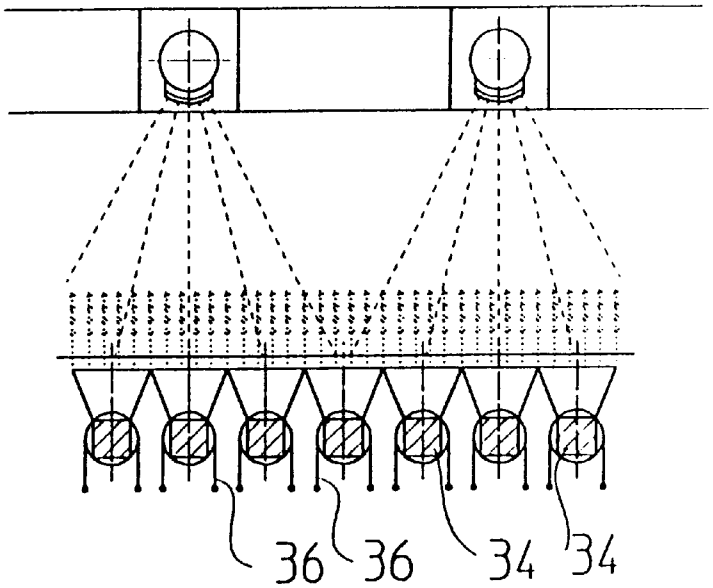
FIG. 4 shows a view as in FIG. 2 of the further embodiment of the invention according to FIG. 3.
Figure 3:
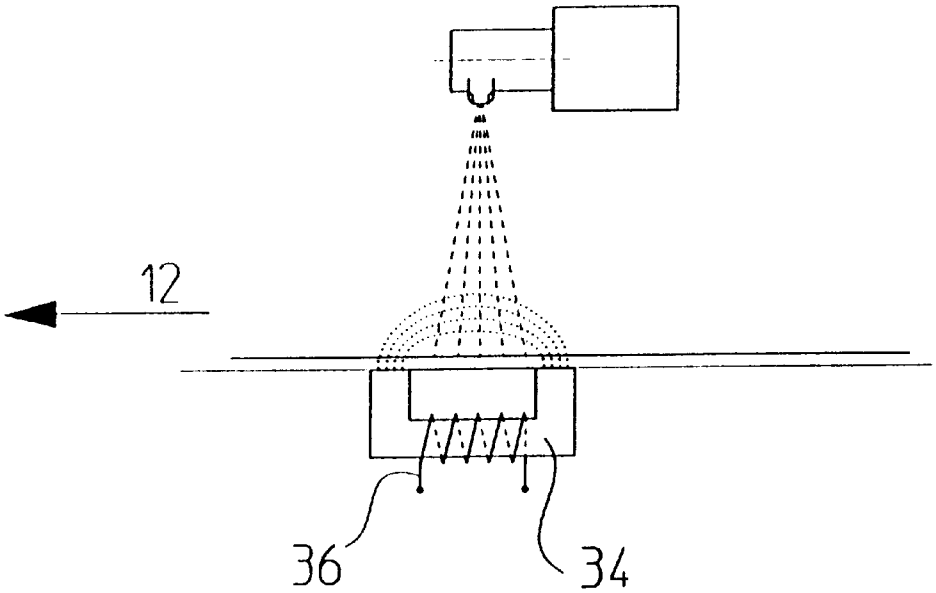
FIG. 3 shows a view as in FIG. 1 of a further embodiment.

In the further exemplary embodiment represented in FIGS. 3 and 4, a plurality of electromagnets 34 has been arranged, parallel and in a row, transverse to the conveying direction 12, through whose respective coils 36 the current flows in the same direction, so that like poles are adjacent to each other, transverse to the conveying direction 12. It is then possible, corresponding to the width of the sheets of paper, to turn off individual electromagnets, so that contamination of the printing press outside the width of the sheets of paper is prevented.

Figure 5:
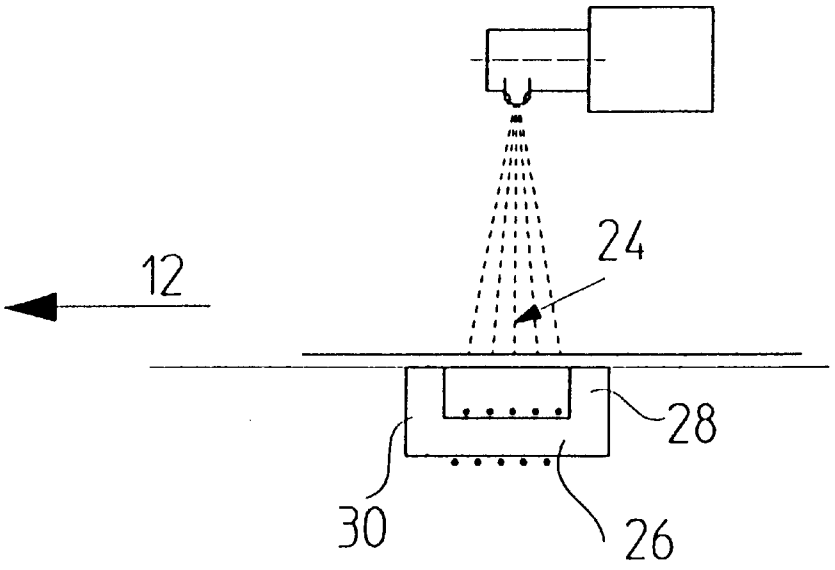
FIG. 5 shows a plan view as in FIG. 1 of a further embodiment.

The magnet(s) is/are preferable arranged as shown in FIG. 5. In this case the one pole 28 is located directly in the deposition area 24 of the powder, and the other pole 30 downstream in the conveying direction 12.

Figure 6:
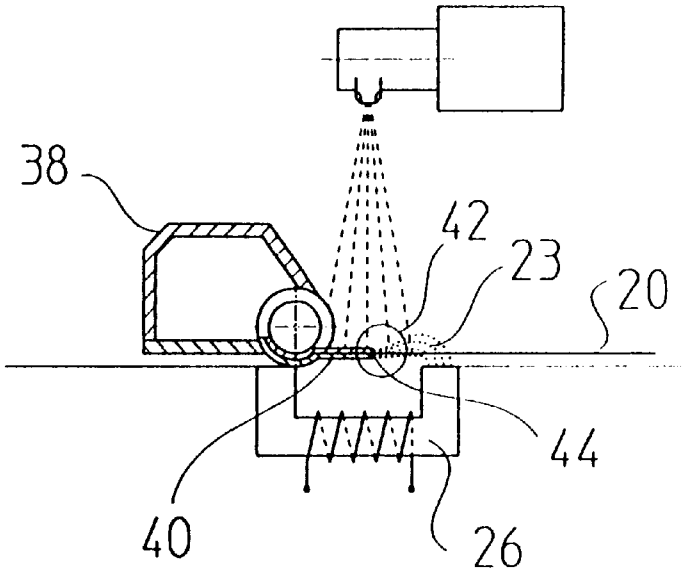
FIG. 6 shows an embodiment of the invention with conveying means for a sheet of paper.

In the exemplary embodiment shown in FIG. 6, the device in accordance with the invention has conveying means 38, having gripper elements 40, with which the sheet of paper 20 is grasped at its front edge 42 for transport.

So that the magnetic field 23 is not disturbed by the massive conveying means 38 with its a gripper element 40, the conveying means 38 has a portion made of a non-magnetizable material, for example plastic. The gripper element 40 is advantageously made of a magnetizable material, since in that case, its free edge 44 becomes a magnetic pole when the conveying means 38 moves over the magnet 26 and the gripper element 40 is magnetized. By means of this, more powder is deposited in the area of the front edge 44 of the sheet of paper 20.

What is claimed is:

1. A method for dusting strip- or sheet-shaped products, the method comprising the steps of:

a) disposing at least one spray nozzle at a substantial separation from the product to define a gap;

b) spraying a powder/air mixture on the product at a deposition area, wherein said powder can be magnetized, said powder spreading in said gap to generate a deposition area having a size substantially greater than an output diameter of said spray nozzle;

c) conveying the product past said spray nozzle in a transport direction; and d) disposing a magnet means below the product, said magnet means having a first pole disposed below the product proximate said disposition area, and a second pole disposed below the product downstream of said first pole in said transport direction to generate a magnetic field in a region of said gap between said spray nozzle and the product, said magnetic field exercising a downward force on said powder along said transport direction between said first and said second poles.

2. A device for dusting strip- or sheet-shaped products, the device comprising:

at least one spray nozzle for spraying a powder/air mixture on the product at a deposition area, wherein said powder can be magnetized, said spray nozzle disposed at a substantial separation from the product to define a gap through which said powder spreads to cover said deposition area, said deposition area having a size which is substantially larger than an output diameter of said spray nozzle;

means for conveying the product past said spray nozzle in a transport direction; and magnet means having a first pole and a second pole, said first pole disposed below the product proximate said deposition area, and said second pole disposed below the product downstream of said first pole in said transport direction, wherein said magnet means generates a magnetic field in a region of said gap between said spray nozzle and the product, said magnetic field exercising a downward force on said powder along said transport direction between said first and said second poles.

3. The device of claim 2, wherein said magnet means comprises at least one permanent magnet.

4. The device of claim 2, wherein said magnet comprises at least one electromagnet.

5. The device of claim 2, wherein said magnet means comprises a magnet with a U-profile, whose U-legs form said first and said second poles, said first and said second poles extending transversely to said transport direction of the product over a width of the product.

6. A device for dusting strip- or sheet-shaped products, the device comprising:

at least one spray nozzle for spraying a powder/air mixture on the product at a deposition area, wherein said powder can be magnetized, said spray nozzle disposed at a substantial separation from the product to define a gap through which said powder spreads to cover said deposition area, said deposition area having a size which is substantially greater than an output diameter of said spray nozzle;

means for conveying the product past said spray nozzle in a transport direction; and a plurality of electromagnets which are arranged parallel and next to each other, transversely to said transport direction of the product, each electromagnet having a first pole and a second pole, said first-pole disposed below the product proximate said deposition area, and said second pole disposed below the product downstream of said first pole in said transport direction, wherein said plurality of electromagnets generate a magnetic field in a region of said gap between said spray nozzle and the product, said magnetic field exercising a downward force on said powder along said transport direction between said first and said second poles.

7. The device of claim 2, wherein said conveying means is disposed on a same side of the product as said spray nozzle, said conveying means comprising a first member made of a non-magnetizable material and a second member made of a magnetizable material, said second member defining a gripper element cooperating with the product to grasp the product at a front edge thereof.

8. The device of claim 7, wherein said powder is covered or coated with iron particles.

9. The device of claim 7, wherein said powder comprises powder particles having covering iron particles on their surface.

10. A device for dusting strip- or sheet-shaped products, the device comprising:

at least one spray nozzle for spraying a powder/air mixture on the product at a deposition area, wherein said powder can be magnetized, said spray nozzle disposed at a substantial separation from the product to define a gap through which said powder spreads to generate a deposition area having a size which is substantially greater than an output diameter of said spray nozzle; and magnet means having a first pole and a second pole, said first pole disposed below the product proximate said deposition area, and said second pole disposed below the product downstream of said first pole in said transport direction, wherein said magnet means generates a magnetic field in a region of said gap between said spray nozzle and the product, said magnetic field exercising a downward force on said powder along said transport direction between said first and said second poles, said magnet means having a magnet with a U-profile whose U-legs form said first and said second pole and which extend transversely to a conveying direction of the product over a width of the product.

11. A device for dusting strip- or sheet-shaped products, the device comprising:

at least one spray nozzle for spraying a powder/air mixture on the product at a deposition area, wherein said powder can be magnetized, said spray nozzle disposed at a substantial separation from the product to define a gap through which said powder spreads to generate a deposition area having a size which is substantially greater than an output diameter of said spray nozzle; and permanent magnet means having a first pole and a second pole, said first pole disposed below the product proximate said deposition area, and said second pole disposed below the product downstream of said first pole in said transport direction, wherein said permanent magnet means generates a magnetic field in a region of said gap between said spray nozzle and the product, said magnetic field exercising a downward force on said powder along said transport direction between said first and said second poles.

* * * * *